US005960556A

United States Patent [19]

Jansen

[11] Patent Number: 5,960,556

[45] **Date of Patent: *Oct. 5, 1999**

[54] METHOD FOR DRYING SHEATHING IN STRUCTURES

[76] Inventor: Phillip E. Jansen, P.O. Box 850, Cornelius, N.C. 28031

[ * ] Notice: This patent issued on a continued prosecution application filed under 37 CFR 1.53(d), and is subject to the twenty year patent term provisions of 35 U.S.C. 154(a)(2).

[21] Appl. No.: 08/882,189

[22] Filed: Jun. 25, 1997

[51] Int. Cl.[6] ..... F26B 5/04

[52] U.S. Cl. ..... 34/402; 34/443; 34/487; 34/507

[58] Field of Search ..... 34/402, 443, 467, 34/481, 487, 507, 104, 225, 233; 454/186, 232, 235, 305; 239/419.3, 419.5; 52/302.1, 302.3, 408

[56] References Cited

U.S. PATENT DOCUMENTS

| | | | |
|---|---|---|---|
| 2,703,911 | 3/1955 | Griffin | 20/4 |
| 3,578,064 | 5/1971 | Mills | 164/281 |
| 4,261,759 | 4/1981 | Cawley | 134/6 |
| 4,534,119 | 8/1985 | Glicksman | 34/95 |
| 4,945,673 | 8/1990 | Lavelle | 43/124 |
| 5,155,924 | 10/1992 | Smith | 34/22 |
| 5,408,759 | 4/1995 | Bass | 34/104 |
| 5,419,059 | 5/1995 | Guasch | 34/443 |
| 5,555,643 | 9/1996 | Guasch | 34/442 |

*Primary Examiner*—Henry A. Bennett
*Assistant Examiner*—Steve Gravini
*Attorney, Agent, or Firm*—Karl O. Hesse

[57] ABSTRACT

An improved system is disclosed drying interior layers of sheathing by reducing moisture in narrow wall spaces, particularly between layers of sheathing and/or insulation board. The method involves inserting a special nozzle into a hole drilled into the wall. The nozzle has a depth gauge in the form of a shoulder, calibrated screw threads or other equivalent means to control the placement of a drying substance into the space without damaging the insulation board or blocking the outlet for the drying substance which may be warm, low humidity air.

17 Claims, 3 Drawing Sheets

METHOD FOR DRYING SHEATHING IN STRUCTURES

BACKGROUND OF THE INVENTION

1. Field of the Invention

This invention relates to reducing moisture in the walls and floors or ceilings of structures which have become wet and more particularly to drying inner layers of sheathing.

2. Description of the Prior Art

At present, a number of wall drying systems have been designed which provide drying air into a wall cavity generally in order to dry out the structural members and sheathing before degradation sets in. An example is U.S. Pat. No. 5,155,924 by Terry C. Smith. This patent describes a blower and hose system for pushing relatively drier room air into the spaces between floor and wall where the drying action of the air circulation then takes place. Holes are cut in the wall or flooring is removed as necessary to provide access, and various diverters are provided to direct the air into the wall cavity.

U.S. Pat. No. 5,408,759 by Lenny Bass shows more flexible devices for diverting the air into the wall cavity. A main extendable chamber has a number of flexible air ducts connected to it for carrying the drying air from the chamber into the wall. Each duct terminates in a piece of PVC pipe which is inserted into a wall access hole. Further U.S. Pat. Nos. 5,419,059 and 5,555,643 show diverting the drying air into the wall through the electrical switch and power outlet boxes found in most walls thereby avoiding or minimizing the number of new access holes that must be opened and later repaired.

A problem in the use of such prior art drying apparatus however is that the moisture may not be in the main wall cavity. Openings for electrical boxes, interior wall access holes or the expansion spaces covered by moldings are in communication with the main wall and floor cavities but may not provide access to the moisture which in some cases is lodged between layers of sheathing and insulation and vapor barriers. A serious moisture problem has been found to exist in some structures using "Exterior Insulation Finish System", (EIFS) in that a crack around a window or other wall opening will admit rain water into the space between the exterior styrofoam insulation and the outer wall sheathing. Since the moisture is on the outside of the sheathing, drying the interior of the wall cavity as shown in the prior art is only minimally effective in preventing sheathing rot and structural damage.

SUMMARY OF THE INVENTION

The instant invention provides a much more efficient method and apparatus for drying out moisture that becomes trapped between sheathing layers in a wall or ceiling.

It is an advantage of the invention that a drying medium which may include fungicidal and other treatment is placed in very small spaces between layers of sheathing.

It is a further advantage of the invention that the placement of drying medium is controlled so as to allow higher pressures that may be necessary to force the air through the small cracks between the layers of sheathing.

It is a still further advantage of the invention that drying medium is placed into the moisture bearing spaces using special nozzles or probes that direct the air into the plane of the space to be dried with a minimum of back pressure.

It is an even further advantage of the invention that a retaining shape is provided in the drying medium injecting nozzle so as to hold the nozzle in place against the higher pressures that may be necessary to force the air through the small cracks between the layers of sheathing.

These and other advantages are obtained by a method of providing access holes into the moisture bearing space between the sheathing layer and other layers such as insulation or further sheathing and injecting drying air using a special nozzle according to the invention

DETAILED DESCRIPTION OF A PREFERRED EMBODIMENT

Figure 1:
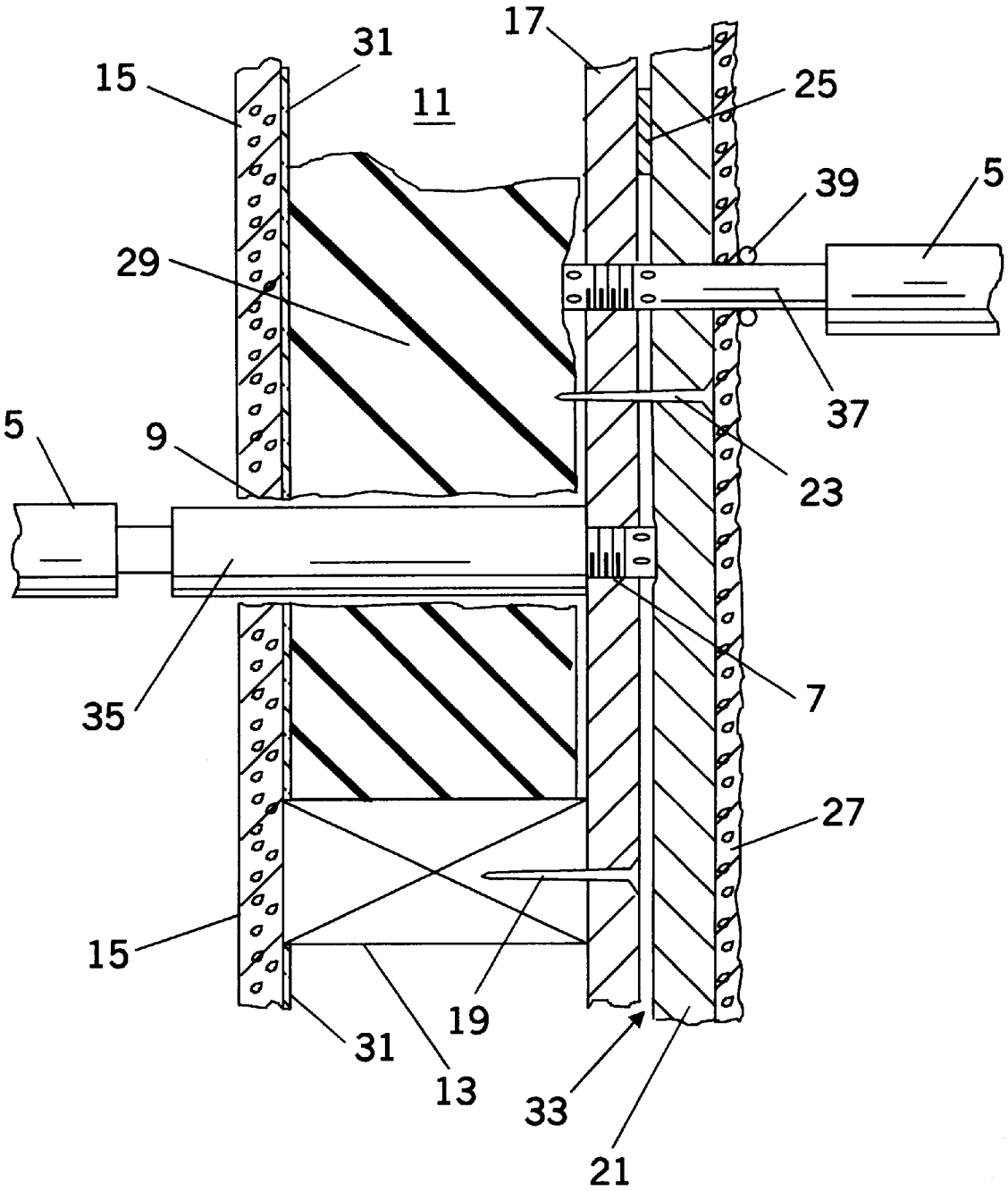
FIG. 1 shows cross sectional view of a wall looking down from the top with the nozzles of FIG. 2 and FIG. 4 in place for removing moisture between the outer wall sheathing and exterior insulation.

Referring now to the Figures, a detailed description of the invention will be set forth. Starting with FIG. 1, a typical residential wood framed wall is shown in plan cross section. It will be understood that the invention applies equally well to steel framed walls found in commercial structures as well as masonry veneer or hard coat stucco over a frame building having sheathing which may become moist due to leaks.

A wall cavity 11 is supported by 2×4 framing lumber 13 and enclosed by a layer of gypsum board 15 on the interior surface and a layer of oriented strand board (OSB) 17 on the outside of the 2×4 13. Other forms of exterior sheathing include exterior gypsum board and plywood which may be used in lieu of the OSB. The gypsum board and OSB are often fastened to the framing with nails 19 or screws. A layer of styrofoam sheathing 21 is then applied to the OSB 17 using further nails 23 or patches of glue 25. Mechanically protective layers of finish coat stucco 27 are then applied to the styrofoam in the normal manner with a trowel to complete the wall. The wall cavity usually also contains batts of insulation material 29 to reduce air flow in the wall cavity 11 and thereby reduce heat convection. Likewise most walls include a moisture barrier 31 to block the passage of moist room air into the wall cavity 11 where it may condense and reduce the insulating effectiveness of insulation 29. Moisture barrier 31 may also serve as a radiation barrier to reduce radiant heat flow. A nozzle 35 according to the invention is shown in place for receiving drying medium in the form of warm dry air from a source outside of the wall and causing the drying medium to flow into the space 33 of the wall.

Nozzle 35 is shown inserted into an opening 9 made into the interior sheet gypsum board 15, the vapor barrier 31 and insulation 29 of the wall of FIG. 1. A smaller hole 7 has been made in the outer sheathing 17 which in this embodiment, is the sheathing to be dried. Hole 7 engages the threads 51 of the nozzle 35 to hold the nozzle in place. The threads themselves provide a substantial seal preventing the drying air from escaping around the nozzle. In this embodiment, the space 33 is the space between outer wall sheathing 17 and styrofoam insulation 21 that may have become wet from a leak around a window for example. Nozzle 35 is screwed into the sheathing 17 so that the air outlets 55 communicate with the space 33. Hose 5 provides the drying air. It will be recognized by those skilled in the art of reducing moisture that other gases and/or substances may be injected into the space 33 in place of, or in addition to the air.

Although the nozzle 35 has been shown in place in a wall for injecting low humidity air into a narrow space at a controlled distance, it will be understood that additional nozzles may be inserted into the wall to allow the moisture to escape from the space 33 in the form of higher humidity air. Further, these escape nozzles may be connected to a partial vacuum to assist in air flow.

Nozzle 35 is a preferred embodiment of the invention which is installed into the wall from the interior of a room enclosed by the wall being dried. Nozzle 37 is an alternate embodiment which may be installed into the wall from the exterior of the wall. It will be understood that nozzle 35 could also be installed from the exterior of a wall but a larger hole would have to be made in the finish coat and the outlets 55 would have to be provided in the shoulder area of the nozzle 35 in order to communicate with the space 33.

Nozzle 37 is held in place and injects drying air into space 33 in the same way as nozzle 35. Nozzle 37 however, is intended to require only a small hole to be later repaired in the wall surface and, has no shoulder to help seal the nozzle into the wall. Accordingly it may be advantageous to apply a bead of caulk 39 around the nozzle 37 to retain the drying medium in the space 33. It will be understood that other sealing means can be employed as element 39 such as an "O" ring or other equivalent. Nozzle 37 is also useful in drying sheathing behind headers and sills since it requires only a small hole.

Figure 2:
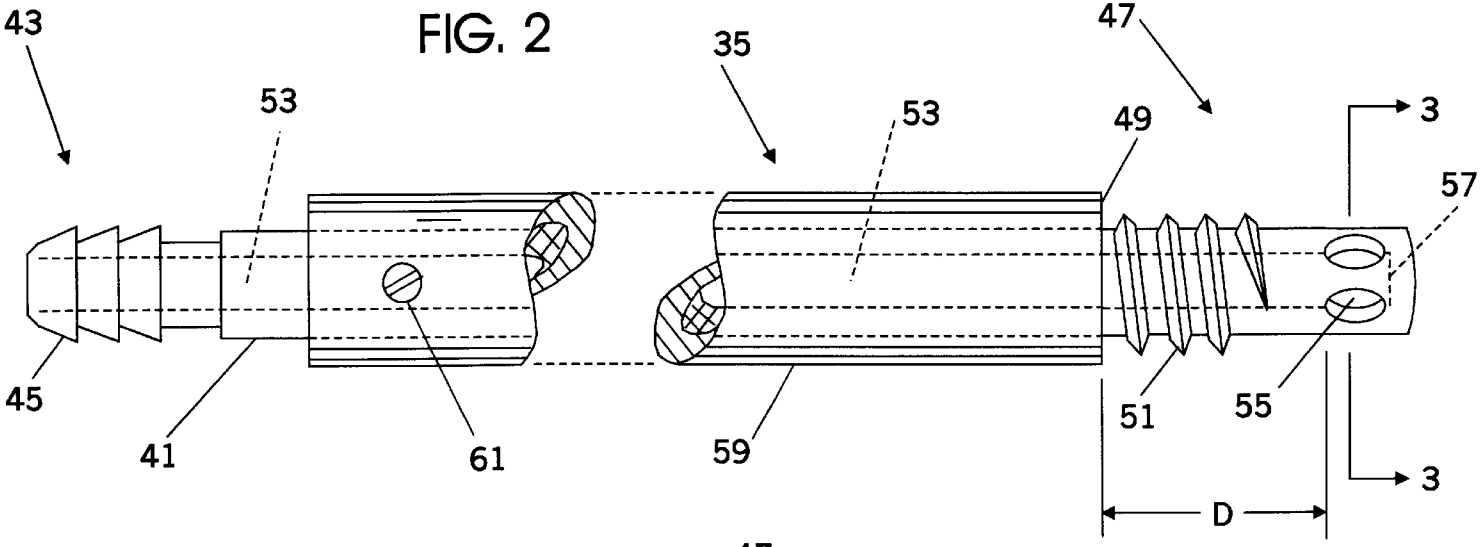
FIG. 2 is a view of a preferred embodiment of a special nozzle according to the invention.

FIG. 2 is a more detailed side view of a preferred embodiment of the special nozzle 35 for inserting air flow into the space 33 of the wall of FIG. 1. The body of the nozzle is a cylindrical tube 41 having an air input end 43 which has a conventional air hose connection 45 to which a supply of drying air under pressure can be connected. An example of such a supply is the Injectidry brand system provided by Injectidry Corporation. At another end of the body 41 of the nozzle 35 according to the invention, is the working end 47 which places the drying medium into the space 33 of FIG. 1. At end 47 is a depth gauge in the form of shoulder 49 and a retainer in the form of screw threads 51. Running the length of the nozzle 35 is an internal passage 53 through which the drying air is conveyed to peripherally placed outlets 55. When the nozzle 35 has been screwed into a hole in a layer of moist sheathing, the shoulder will come up against the surface of the sheathing and create a noticeable increase in the torque required to rotate the nozzle 35. In this way the installer will know that the nozzle is seated in operating position with the outlets 55 communicating with a space on the other side of the sheathing, even if the layer of sheathing is an internal layer whose surface is not visible by the installer.

Figure 3:
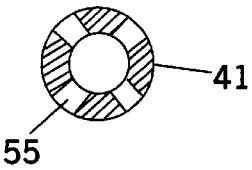
FIG. 3 is a cross sectional view of the nozzle taken through the openings of the nozzle.

Just beyond a distance D corresponding to the thickness of the sheathing to be dried, are the previously mentioned outlets 55. The end of the passage 53 is closed at 57 to direct the flow of air into the space between layers of sheathing in a plane parallel to the plane of the sheathing. The outlets 55 are shown in cross section in FIG. 3. The body 41 of nozzle 35 appears shaded in FIG. 3.

Shoulder 49 may be fixed as shown in the apparatus of FIG. 1 or it may be adjustable as shown in FIG. 2. Shoulder 49 is provided by the end of a sleeve 59 that slips over nozzle 41 before the hose is attached. Sleeve 59 has an adjustable fastener in the form of a set screw 61 which bears on the outer surface of nozzle 41. By loosening the set screw 61 and sliding the sleeve 59 back or forth, the depth gauge afforded by shoulder 49 can be adjusted to accommodate varying thickness sheathing to be dried.

Figure 4:
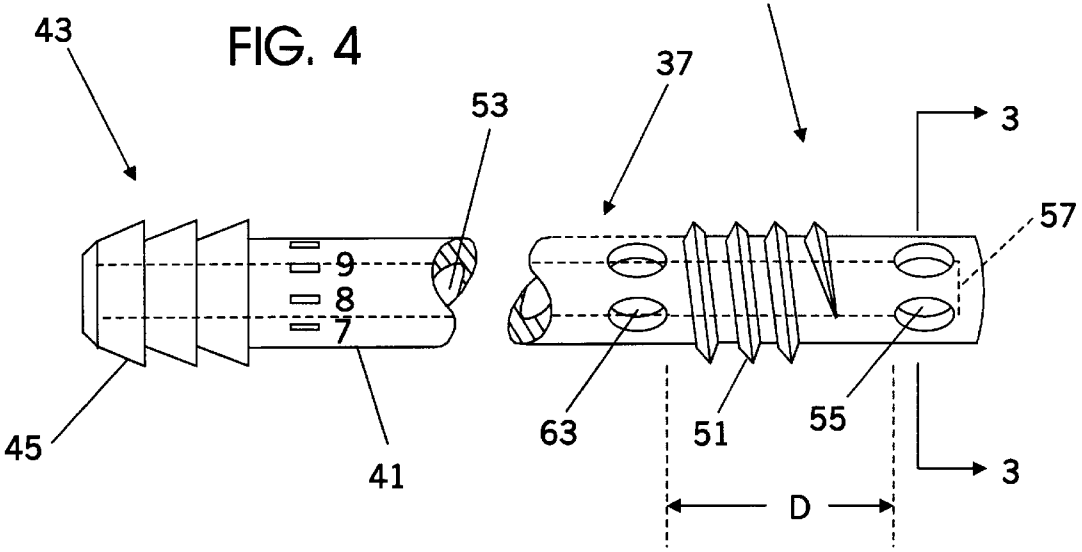
FIG. 4 is a view of an alternate embodiment of the nozzle of the invention.

Referring now to FIG. 4, an alternate embodiment of the nozzle is shown as nozzle 37 which does not have a shoulder but relies on the threads to provided a seal between the nozzle and the sheathing being dried. In this embodiment, the screw threads 51 are calibrated so as to move the nozzle 37 into a hole in sheathing of known thickness by a controlled amount per degree of angular rotation. In this way, the depth gauge and the retaining means may be combined in form of the threads 51. Markings 65 on the body 41 of the alternate embodiment of FIG. 4 give an indication of the angle through which the body has been rotated to assist the installer in obtaining the proper depth. The alternate embodiment allows one nozzle to be properly seated in a hole in various sheathing of differing thickness whereas using a fixed shoulder as a depth gauge requires a nozzle of different dimension for each thickness of sheathing.

The nozzle 37 also has a second set of outlets in the form of holes 63 spaced back from holes 55 by a distance D corresponding to the thickness of the sheathing to be dried. These holes 63 provide drying air to both sides of the sheathing to be dried and are particularly advantageous when the nozzle is installed in the wall from the outside. In that event, holes 63 communicate with space 33 as shown in FIG. 1.

The alternate embodiment of FIG. 4 is also useful when the sheathing to be dried is behind a header, sill or other structural member. When using nozzle 37, only a small hole need be drilled in the structural member and outlets 55 can be brought to communicate with space 33 by rotating the nozzle to screw it into the structural member. In this application, holes 63 will be closed by the structural member to allow all of the air to flow into space 33. The number of holes provided at second outlets 63 may be varied to adjust air flow through the outlets in communication with space 33. When installed from the exterior, the number may be increased and when installed from the interior, the number may be decreased.

Figure 5:
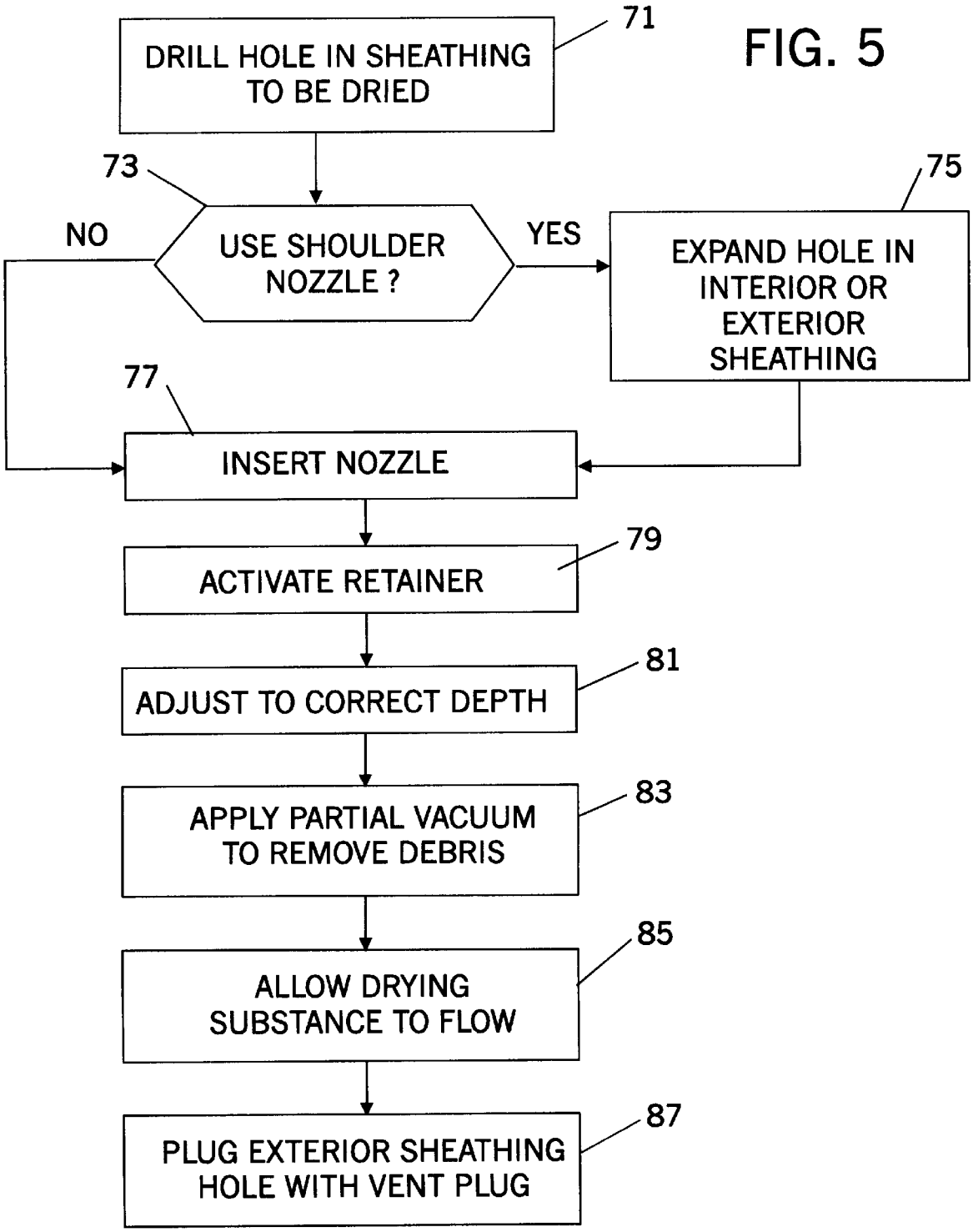
FIG. 5 is a flow diagram showing the acts of the method according to the invention.

Referring now to FIG. 5, a flow diagram showing the method of the invention will be described. At block 71, a hole is made in the sheathing to be dried and any loose chips and debris are removed using a partial vacuum to avoid blocking the outlets in the nozzle. If this sheathing to be dried is an inner layer of sheathing, holes will of necessity, also be made in the outer layers in order to reach the inner layer. If at decision block 73, a nozzle of FIG. 4 is to be used, there will be no shoulder and the act of expanding the holes at block 75 is not performed.

The nozzle is inserted at block 77, bringing the threads 51 into contact with the hole made at block 71. The retainer, which are the threads in the preferred embodiment, is then activated by rotating the body of the nozzle. Rotation is continued at block 81 until the shoulder comes against the sheathing to be dried or the body has been rotated through the proper angle to reach the correct depth.

At block 83, a partial vacuum is applied to remove any debris that may have partially clogged outlets 55. It will be understood that the material of the sheathing to be dried and the shape of the holes that form outlets 55 will determine the amount debris collected and therefore there may be no need to suck out such debris. Finally at block 85, the drying air or other substance or medium is caused to flow into space 33 to dry sheathing 17.

After the moisture has been removed from the sheathing 17 and space 33, the nozzle can be removed and the hole 9 in the interior gypsum board can be closed with joint compound. Likewise, if the nozzle was installed from the exterior of the wall as shown with nozzle 35 in FIG. 1, the exterior hole can be patched with finish coat stucco. An alternative shown at block 87 of FIG. 5 is to plug an exterior hole with a commercially available vent plug to allow continued ventilation as a precaution against further moisture build up in space 33.

Having described the invention in terms of a preferred embodiment thereof, it will be recognized by those skilled in the art that various changes in addition to those described above may be made, in the structure and detail of the implementations of the invention without departing from the spirit and scope of the invention which is measured by the following claims.

I claim:

1. Method of reducing moisture in a sheathing of known thickness and reducing moisture in a space between layers of sheathing, the space between layers being thinner than the known thickness, comprising the acts of:

making a hole in the sheathing of known thickness for access to the space between sheathing layers;

installing a nozzle through the hole and into the space between sheathing layers, the body of the nozzle having a depth gauge for controlling the depth which the nozzle may be installed into the space and a retainer for holding the body of the nozzle in place, so that an outlet is in communication with the space between sheathing layers;

connecting a supply of drying substance to the nozzle allowing the substance to flow through an outlet of the nozzle into the space between sheathing layers.

2. Method of claim 1 further comprising the act of:

rotating the body of the nozzle to engage threads on the outer surface of the body of the nozzle with the inside surface of the hole to retain the body of the nozzle in the hole.

3. Method of claim 2 further comprising the act of:

ceasing rotation when rotation requires noticeably more torque indicating that a depth gauge has contacted a surface of the sheathing of known thickness.

4. Method of claim 2 further comprising the act of:

limiting rotation of the body of the nozzle to a predetermined angle to control the depth which the nozzle may is inserted into the space.

5. Method of claim 1 wherein the act of connecting a supply of drying substance to the nozzle further comprises:

applying a partial vacuum to said nozzle to remove debris that may be obstructing the outlet before allowing the drying substance to flow through the outlet of the nozzle into the space between sheathing layers.

6. Method of claim 1 wherein:

the act of making a hole in the sheathing of known thickness further comprises making, in alignment with the hole in the sheathing of known thickness, a hole in an interior wall sheathing; and the act of installing the nozzle further comprises inserting the nozzle through the hole in the interior wall sheathing and installing the nozzle in the hole in the sheathing of known thickness so that air can be provided into the space between layers of sheathing from the inside of a room enclosed by the wall.

7. Method of claim 1 wherein:

the act of making a hole in the sheathing of known thickness further comprises making, in alignment with the hole in the sheathing of known thickness, a hole in an exterior wall sheathing; and the act of inserting the nozzle further comprises inserting the nozzle through the hole in the exterior wall sheathing and the sheathing of known thickness so that air can be provided into the space between layers of sheathing and to both sides of the sheathing of known thickness from the outside of a structure enclosed by the wall.

8. Method of reducing moisture in a first layer of sheathing of known thickness and reducing moisture in a space between the first layer of sheathing and a second layer of sheathing, both layers being internal to a wall, the space between layers being thinner than the known thickness, comprising the acts of:

making a hole in one of the first layer of sheathing and the second layer of sheathing for access to the space between sheathing layers;

installing a nozzle through the hole and into the space between sheathing layers, so that the nozzle is in communication with the space between sheathing layers;

connecting a supply of drying substance to the nozzle allowing the substance to flow through an outlet of the nozzle into the space between sheathing layers.

9. Method of claim 8 wherein:

the act of making a hole comprises making a hole in the first layer of sheathing and further comprises making, in alignment with the hole in the first layer of sheathing, a hole in a wall interior surface sheathing; and the act of installing the nozzle further comprises inserting the nozzle through the hole in the wall interior surface sheathing and installing the nozzle in the hole in the first layer of sheathing so that air can be provided into the space between layers of sheathing from the inside of a room enclosed by the wall.

10. Method of claim 8 wherein:

the act of making a hole comprises making a hole in the second layer of sheathing and further comprises making, in alignment with the hole in the second layer of sheathing, a hole in a wall exterior stucco layer; and the act of inserting the nozzle further comprises inserting the nozzle through the hole in the exterior stucco layer and the second layer of sheathing so that the drying substance can be provided into the space between layers of sheathing from the outside of a structure enclosed by the wall.

11. Method of claim 10 wherein:

the act of making a hole comprises making a hole in both the first layer of sheathing and the second layer of sheathing; and the act of inserting the nozzle further comprises:

causing the nozzle to engage the inside surface of the hole in the first layer of sheathing by inserting the nozzle through the hole in the wall exterior stucco layer into the first layer of sheathing so that air can be provided into a space between layers of sheathing and into an interior wall cavity beyond both layers of sheathing from the outside of a structure enclosed by the wall.

12. Method of reducing moisture in a exterior insulation finish system wall exterior sheathing and reducing moisture in a space between the layer of exterior sheathing and a layer of exterior insulation sheathing, the space between layers being thinner than the layer of exterior sheathing and thinner than the layer of exterior insulation sheathing, comprising the acts of:

making a hole in an exterior finish stucco layer and in alignment therewith, extending the hole through the layer of exterior insulation sheathing for access to the space between sheathing layers;

installing an air hose to the hole so that dry air can be carried into the space between sheathing layers;

connecting a supply of dry air to the hose allowing the dry air to flow through the hole into the space between sheathing layers.

13. Method of claim 12 wherein:

the act of making a hole in the exterior finish stucco layer and the layer of exterior insulation sheathing for access to the space between sheathing layers further comprises:

making, in alignment with the hole in the exterior insulation sheathing, a hole in the wall exterior sheathing so that the act of installing the air hose causes dry air to be provided into the space between layers of sheathing and into an insulation cavity inside the wall.

14. Method of claim 12 wherein the act of installing an air hose further comprises:

the act of inserting a nozzle through the hole in the exterior finish stucco layer and the layer of exterior insulation sheathing to engage an inside surface of the hole in the wall exterior sheathing.

15. Method of claim 12 wherein the act of installing the air hose further comprises:

the act of inserting a nozzle through the hole in the exterior finish stucco layer and the layer of exterior insulation sheathing to carry the dry air.

16. Method of reducing moisture in a exterior insulation finish system wall exterior sheathing and reducing moisture in a space between the layer of exterior sheathing and a layer of exterior insulation sheathing, the space between layers being thinner than the layer of exterior sheathing and thinner than the layer of exterior insulation sheathing, comprising the acts of:

making a hole in an interior surface sheathing layer of the wall and in alignment therewith, through the exterior sheathing layer for access to a space between the exterior sheathing layer and an exterior insulation layer;

inserting a nozzle to engage the hole in the exterior sheathing by inserting the nozzle through the hole in the interior sheathing so that dry air can be provided into a space between the layer of exterior sheathing and the layer of exterior insulation from the inside of a structure enclosed by the wall.

17. Method of claim 16 further comprising:

connecting a supply of dry air through a hose to the nozzle allowing the dry air to flow through the hole into the space between the layer of exterior sheathing and the layer of exterior insulation.

* * * * *